US006307520B1

(12) United States Patent
Liu

(10) Patent No.: US 6,307,520 B1
(45) Date of Patent: Oct. 23, 2001

(54) BOXED-IN SLOT ANTENNA WITH SPACE-SAVING CONFIGURATION

(75) Inventor: Duixan Liu, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/625,251

(22) Filed: Jul. 25, 2000

(51) Int. Cl.[7] ..... H01Q 13/10
(52) U.S. Cl. ..... 343/767; 343/702
(58) Field of Search ..... 343/767, 771, 343/702; H01Q 13/00, 13/10

(56) References Cited

U.S. PATENT DOCUMENTS

| | | | | |
|---|---|---|---|---|
| 4,131,892 | | 12/1978 | Munson et awl. | 343/700 MS |
| 4,131,893 | | 12/1978 | Munson et al. | 343/700 MS |
| 4,367,475 | * | 1/1983 | Schiavone | 343/767 |
| 5,677,698 | | 10/1997 | Snowdon | 343/770 |

FOREIGN PATENT DOCUMENTS

| | | | |
|---|---|---|---|
| 9506338 | 2/1995 | (WO) | H01Q/1/22 |

OTHER PUBLICATIONS

John D. Kraus, *Antennas*, pp. 624–645 (2d ed., McGraw–Hill 1988).
David Pogue, The iBook: What Steve Jobs Didn't Say, in MacWorld on the web, pp. 1–3, Jul. 18, 1999.
Anonymous, Apple PowerBook G3 500 MHz Full Review, in PC Magazine on the web, pp. 1–2, date unknown.
Wendy J. Mattson, Fast PowerBooks Start to Arrive, in the MacWeek.com. pp. 1–2, Jun. 7, 1999.
Andy (last name unknown), The Vision Thing: No Strings Attached, in MacWorld on the web, pp. 1–3, Jul. 18, 1999.
Anonymous, Apple Introduces AirPort Wireless Networking, in CreativePro.com on the web, pp. 1–2, Jul. 21, 1999.
Anonymous, Apple PowerBook G4 Technical Specifications, pp. 1–4, 2001.
Anonymous, PowerBook G4 Technical Specifications, pp. 1–4, 2001.
Anonymous, PowerBook G4, pp. 1–4, Jan. 2001.
Color Photograph of Apple® PowerBook® computer showing first antenna on top left of display and second antenna on middle of right display frame, refelcting product as available on or about Jul. 26, 2000, date of product introduction unknown.
Color Photograph of Apple® PowerBook® computer showing enlarged view of antenna on top left of display, reflecting product as available on or about Jul. 26, 2000, date of product introduction unknown.
Color Photograph of Apple® PowerBook® computer showing enlarged view of antenna on middle of right display frame, reflecting product as available on or about Jul. 26, 2000, date of product introduction unknown.

* cited by examiner

*Primary Examiner*—Michael C. Wimer
(74) *Attorney, Agent, or Firm*—Paul J. Otterstedt

(57) ABSTRACT

The boxed-in slot antenna is provided with a conductive box, functioning as a waveguide, which is configured substantially parallel to the ground plane in which the slot is formed, thereby providing significant space savings relative to prior art designs wherein the box is positioned perpendicular to the conductive ground plane. The inventive antenna can be easily constructed using printed circuit board technology, by forming the ground plane as a coating on one side of a printed circuit board substrate, forming the main conductive plane of the conductive box structure on the other side of the printed circuit board, and interconnecting the two using plated through holes (that is, vias). The folded structure of the conductive box of the present invention makes it particularly suited for space-critical applications, such as may be found in laptop computers and other portable and handheld electronic devices, which it is desired to interconnect with a wireless local area network (wireless LAN).

22 Claims, 12 Drawing Sheets

BOXED-IN SLOT ANTENNA WITH SPACE-SAVING CONFIGURATION

BACKGROUND OF THE INVENTION

1. Field of the Invention

The present invention relates to antennas, and more particularly relates to a boxed-in slot antenna having a folded, space-saving configuration, which can be employed in space-critical applications, such as a laptop computer.

2. Brief Description of the Prior Art

There is increased interest in enabling laptop computers and other portable electronic devices to interface with a wireless local area network (WLAN). WLANs may operate under a number of standards, for example, the so-called "Bluetooth" standard. In such systems, an antenna is required to send and receive data via radio frequency (RF) communications.

In portable electronic devices, space is typically at a premium. Accordingly, it is desirable to minimize space to be occupied by an antenna in such devices. One prior art approach to providing an RF antenna which takes up minimal space is disclosed in World Intellectual Property Organization (WIPO) international publication number WO 95/06338 published on Mar. 2, 1995. In this publication, a folded monopole antenna is discussed. The folding of the monopole reduces its height so as to enable it to fit into small areas. However, the folding of the monopole has undesirable effects on the electrical match, frequency bandwidth and electromagnetic fields, requiring the introduction of a shunt inductance between the monopole and the ground plane.

Slot antennas are known in the prior art, and are useful for low-profile or flush installations, such as in high-speed aircraft. A traditional slot antenna is described in the book *Antennas* by John D. Kraus, at pages 624–632 (Second Edition, McGraw-Hill 1988). FIG. 1 shows a prior art slot antenna, designated generally as 10. A conductive ground plane 12, typically metallic, is formed with a slot 14. The slot has a length, L, which is typically equal to half of the electric wavelength $\lambda_e$. The slot 14 typically also has a width, w, which is much less than the wavelength. Such an antenna will radiate equally from both sides of the ground plane 12. It is typically fed by a coaxial cable 16, which can be attached at an off-center feed point in order to obtain a 50 Ohm antenna impedance so as to match the characteristic impedance, typically 50 Ohms, of coaxial cables.

In some applications, it is desirable to have a slot antenna which radiates in only one direction. This can be achieved with a fairly large conductive ground plane, with one side of the slot boxed-in, as shown in FIG. 2. This type of structure is also discussed in the aforementioned Kraus reference book. The prior-art boxed-in slot antenna of FIG. 2 is designated generally as 20. The antenna 20 of FIG. 2 is also formed with a conductive ground plane 22, and with a slot having dimensions L,w as before. The slot is designated as 24. A box structure 26 is used to box-in the slot 24, and typically extends a depth, h, below the surface of the conductive ground plane 22. The distance h is typically one-quarter of the waveguide wavelength $\lambda_g$. The box structure 26 blocks radiation in the rearward direction in FIG. 2, so that radiation in the forward direction is enhanced; further, it doubles the radiation resistance of the original slot antenna 10. Feed can be via a coaxial cable 28. The original slot antenna 10 is not appropriate for use in a handheld electronic device or a laptop computer because of the radiation in both directions, while the prior art boxed-in slot antenna of FIG. 2 is also unsuitable, as the distance h must be so large that the antenna occupies an unacceptably large space. Note that the Kraus reference uses "d" for "h"; the "h" terminology is used herein to avoid confusion with a "d" parameter referred to below with respect to the present invention.

It will be appreciated that the prior art folded monopole approach of the aforementioned WIPO publication results in unadvantageous changes to the electrical match, frequency bandwidth and electromagnetic fields, necessitating the introduction of a shunt inductance. Further, the slot antennas discussed immediately above are unsuitable due to either bi-directional radiation or excessive size.

In view of the foregoing, there is a need in the prior art for a compact antenna suitable for use in laptop computers and other portable electronic devices. There is the need for such an antenna which takes up minimal space, can be easily fabricated, and has desirable electric characteristics.

SUMMARY OF THE INVENTION

The present invention, which addresses the needs identified in the prior art, provides a boxed-in slot antenna wherein the conductive box structure has a folded, space-saving configuration suitable for use in space-limited locations such as a laptop computer. The inventive antenna is for radiation having a free-space wavelength $\lambda$, a waveguide wavelength $\lambda_g$, and an electric half-wavelength $\lambda_e/2$. The antenna includes a conductive ground plane having a slot formed therein, with the slot having a length L which is at least substantially equal to the electric half-wavelength. The slot also has a width w which is less than the length L, and the slot further has a longitudinal axis and first and second longitudinal edges. The antenna also includes a conductive box structure. The conductive box structure in turn comprises a main conductive plane which is substantially parallel to the ground plane and which is spaced a distance d therefrom. The distance d is substantially less than ¼ of the waveguide wavelength $\lambda_g$. The conductive box structure further includes first and second conductive structures which are substantially parallel to each other and which are spaced apart a distance g which is at least substantially equal to L. The first and second conductive structures are substantially perpendicular to the conductive ground plane and the main conductive plane and are also substantially perpendicular to the longitudinal axis of the slot.

The conductive box structure yet further includes third and fourth conductive structures which are substantially parallel to each other and which are spaced apart a distance a, with the third and fourth conductive structures being substantially perpendicular to the conductive ground plane and the main conductive plane, and also being substantially parallel to the longitudinal axis of the slot.

The distance a can preferably be substantially equal to one of: the width w plus ¼ of the waveguide wavelength, and the width w plus ½ of the waveguide wavelength. The first, second, third and fourth conductive structures form conductive paths between the conductive ground plane and the main conductive plane. When viewed in plan, the first, second, third and fourth conductive structures bound the slot.

Accordingly, it will be appreciated that the inventive antenna is an improvement over the prior-art boxed-in slot antenna, inasmuch as the arrangement just described provides a folded, space-saving configuration for the conductive box structure which permits its incorporation into space-limited locations such as a laptop computer. In particular, the distance d can be much less than the distance h in the prior-art type of boxed-in slot antenna.

These and other features and advantages of the present invention will be appreciated by reading the following specification, taken in conjunction with the accompanying drawings, and the scope of the invention will be set forth in the appended claims.

DETAILED DESCRIPTION OF THE INVENTION

Figure 3:
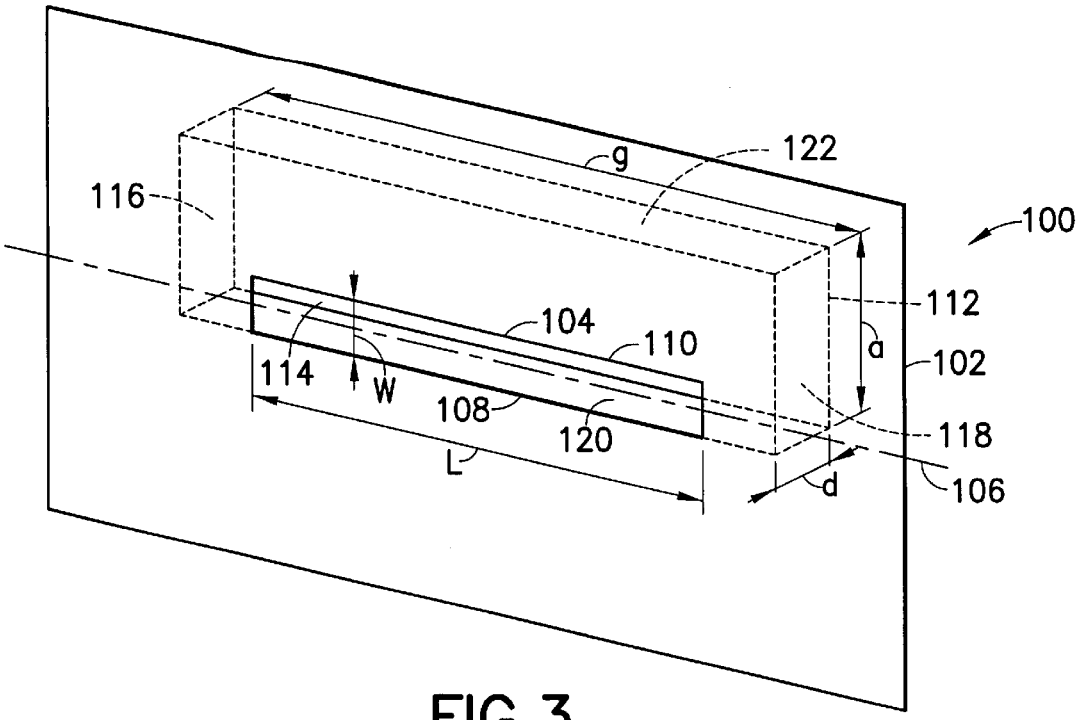
FIG. 3 is a semi-schematic view of one form of boxed-in slot antenna in accordance with the present invention.

Reference should now be had to FIG. 3, which is a semi-schematic pictorial view of one form of boxed-in slot antenna for radiation having a free-space wavelength $\lambda$, a waveguide wavelength $\lambda_g$, and an electric half-wavelength $\lambda_e/2$, in accordance with the present invention. The inventive antenna is designated generally as 100. The antenna 100 includes a conductive ground plane 102, which can be metallic (for example), and which has a slot 104 formed therein. Ground plane 102 has first and second sides. The slot 104 has a length L which is at least substantially equal to the electric half-wavelength. As used herein, "at least substantially equal to" means that L is greater than the electric half-wavelength, or is substantially equal to the electric half-wavelength, where substantially equal is meant to include equal to, or slightly greater than or less than, so long as functionality can be maintained. Slot 104 also has a width w which is less (preferably much less) than the length L, and further has a longitudinal axis 106 and first and second longitudinal edges 108, 110 respectively. It is preferable that the width w satisfy the relationship $w<<\lambda$. Slot 104 can be configured and dimensioned for predetermined radiation performance, for example, for radiation as described above. Those of skill in the antenna art will appreciate how to develop desired dimensions for the slot in view of the guidelines presented herein.

The present invention further includes a conductive box structure 112, which is conductively secured to the conductive ground plane 102 and which is configured to cause the slot antenna 100 to radiate from only a single side (i.e., one of the first and second sides) of the conductive ground plane 102; as depicted in FIG. 3, the slot antenna 100 would radiate outwardly towards the viewer from the conductive ground plane 102, whereas radiation into the paper would be prevented by the conductive box structure 112. Conductive box structure 112 can thus be configured to function as a waveguide to achieve the desired single-sided radiation.

Figure 2:
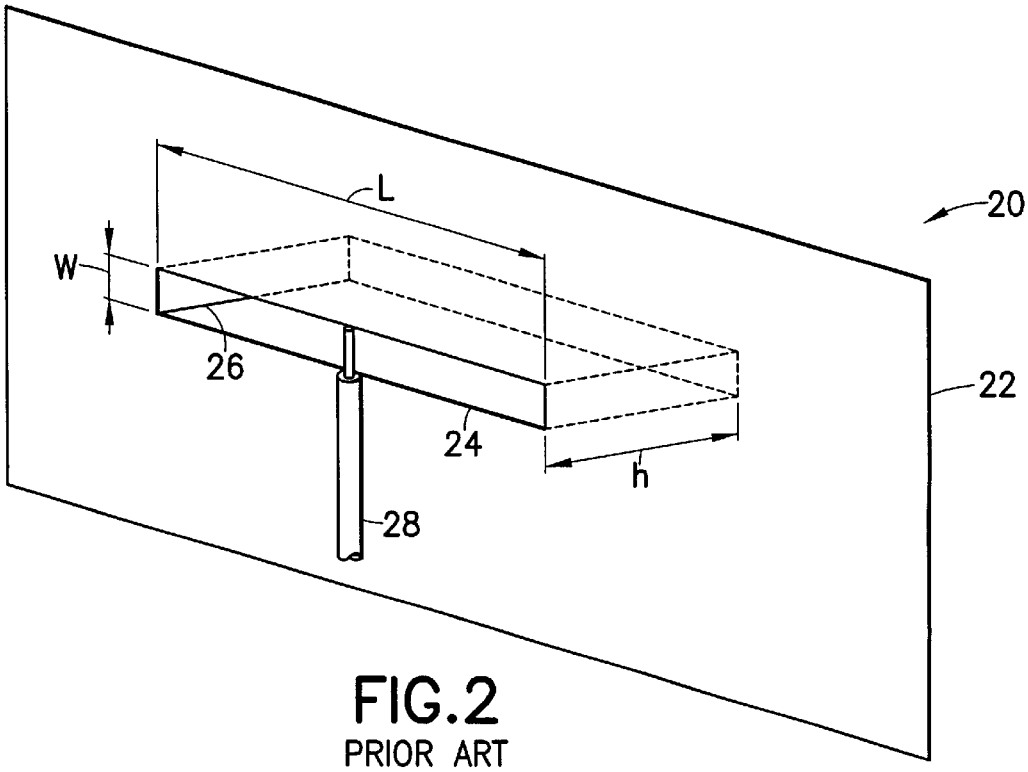
FIG. 2 PRIOR ART
FIG. 2 is a semi-schematic view of a prior-art boxed-in slot antenna.

It will be appreciated that the prior art boxed-in slot antenna 20 shown in FIG. 2 also includes a ground plane with slot and conductive box structure. However, the present invention is improved over the prior art device shown in FIG. 2, in that the conductive box structure 112 is provided with a folded, space-saving configuration (it can be configured in a folded manner parallel to the ground plane 102). In particular, to achieve this configuration, the conductive box structure 112 in turn includes a main conductive plane 114, which is substantially parallel to the conductive ground plane 102 and which is spaced a distance d from the ground plane. The distance d is substantially less than ¼ of the waveguide wavelength $\lambda_g$ and is selected so as to permit the antenna 100 to easily fit into space-limited locations such as a laptop computer. The distance d should be as thin as possible to reduce size, consistent with adequate bandwidth. If d is too small, the bandwidth will be narrow. Appropriate values for d will also be influenced by the properties of the substrate in PCB embodiments of the invention to be discussed below. Any value of the distance d which is substantially less than ¼ of the waveguide wavelength should be considered within the scope of the invention. For example, d could be less than 15% of $\lambda_g$, or preferably less than 10% of $\lambda_g$, or even more preferably less than 5% of $\lambda_g$, consistent with adequate bandwidth. In the Example discussed below, d is about 3.8% of $\lambda_g$. In view of these guidelines, those of skill in the antenna art will be able to select appropriate values for the distance d.

Conductive box structure 112 further comprises first and second conductive structures 116, 118 respectively, which are substantially parallel to each other and which are spaced apart a distance g which is at least substantially equal to L (i.e., either substantially equal to L or greater than L). It is believed preferable that g be at least slightly greater than L. The first and second conductive structures 116, 118 are substantially perpendicular to the conductive ground plane 102 and to the main conductive plane 114, and are also substantially perpendicular to the longitudinal axis of the slot 106.

Figure 1:
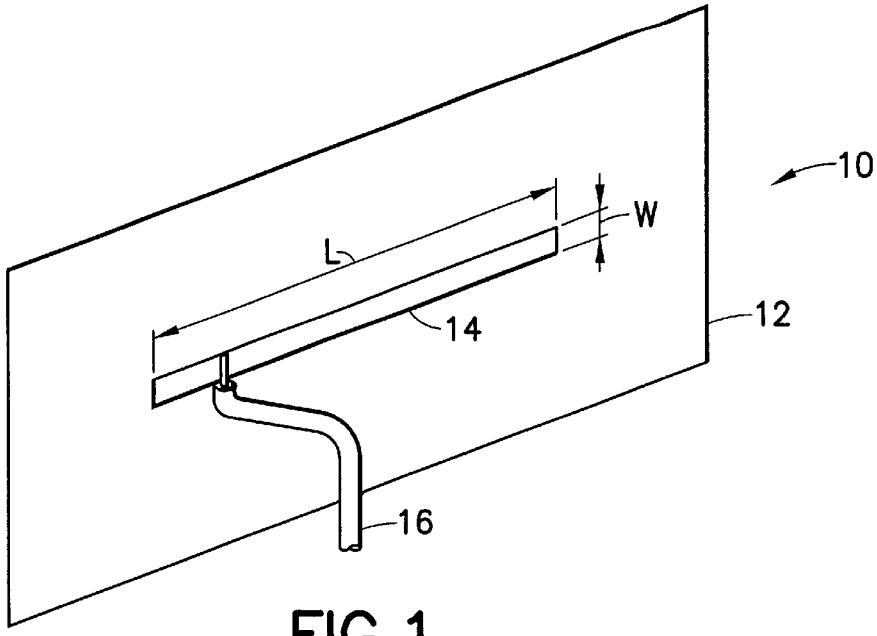
FIG. 1 PRIOR ART
FIG. 1 is a semi-schematic view of a prior-art slot antenna.
Figure 10:
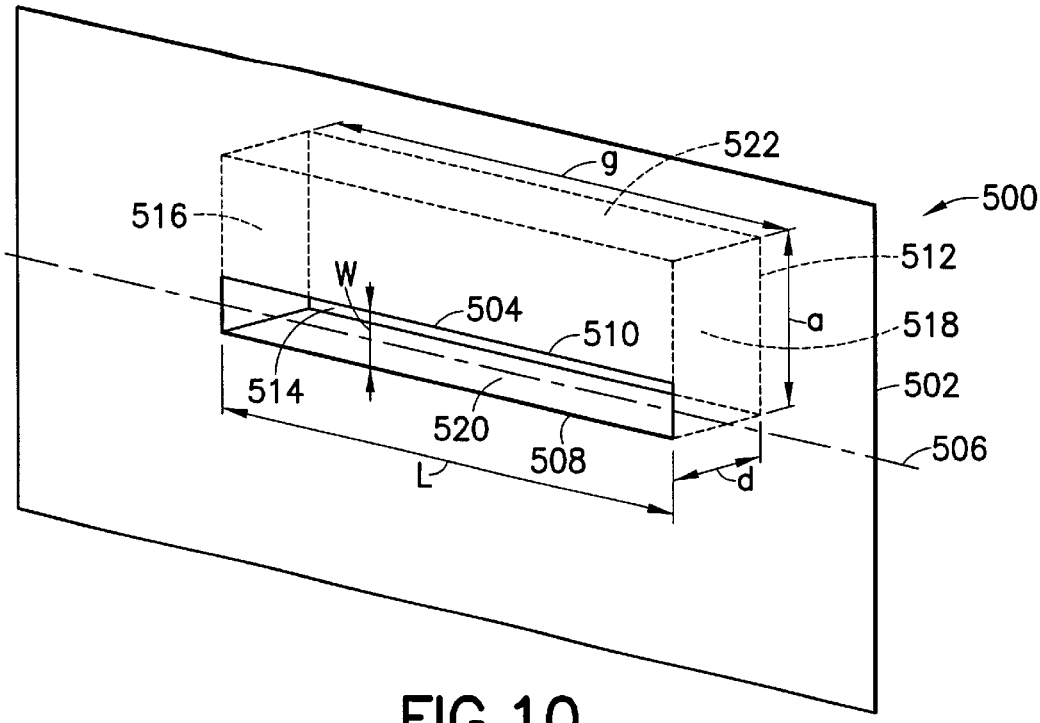
FIG. 10 is a semi-schematic view showing another form of the present invention.
Figure 11:
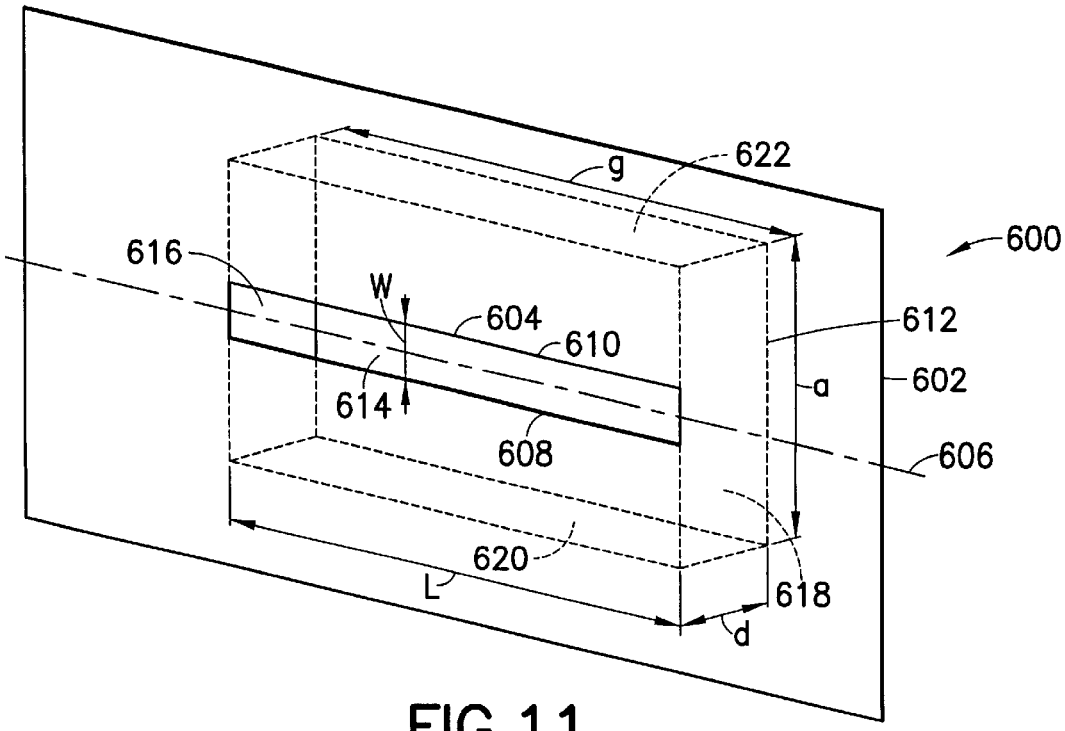
FIG. 11 is a semi-schematic view showing yet another form of the present invention.
Figure 12:
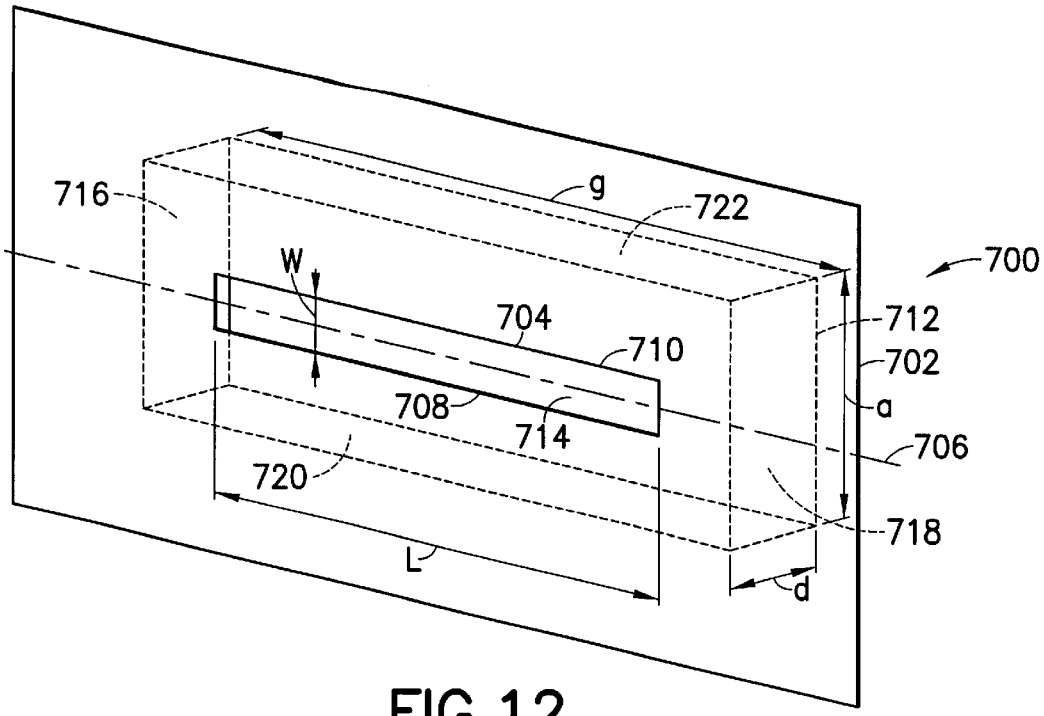
FIG. 12 is a semi-schematic view showing still another form of the present invention.

The conductive box structure 112 of the inventive antenna 100 yet further includes third and fourth conductive structures 120, 122 respectively, which are substantially parallel to each other and which are spaced apart a distance a. The third and fourth conductive structures 120, 122 are substantially perpendicular to the conductive ground plane and the main conductive plane and are also substantially parallel to the longitudinal axis 106 of the slot 104. Note that FIG. 3, like FIGS. 1 & 2, is semi-schematic in nature, in the sense that no thickness is shown for the conductive ground plane 102 or the main conductive plane 114, or the conductive structures 116, 118, 120, 122 respectively. It will be appreciated that this is purely for purposes of illustrative convenience, and the physical thickness of these various items is depicted in the other figures. FIGS. 10, 11 and 12 are also semi-schematic in nature.

The distance a should preferably be substantially equal to either: the width w plus ¼ of the waveguide wavelength, or the width w plus ½ of the waveguide wavelength, but other values can be used as discussed elsewhere herein. As used herein, "substantially equal to" is intended to include precisely equal to, with also a slight variation above and below, so long as functionality can be maintained. The first, second, third and fourth conductive structures 116, 118, 120, 122 respectively form conductive paths between the conductive ground plane 102 and the main conductive plane 114. When viewed in plan, the first through fourth conductive structures bound the slot 104. It will be appreciated that by having the short dimension d of the box structure be perpendicular to the ground plane 102, with the longer dimensions of the conductive box structure a and g being parallel to the ground plane 102, a folded configuration is obtained for the conductive box structure 112, which affords significant space savings when compared with the prior art.

As used herein, a "plan" view refers to a view wherein the conductive ground plane is parallel to the paper on which the view is drawn. Furthermore, "bounding" of the slot by the conductive structures refers to the structures surrounding, or being substantially coincident with, the slot.

Still referring to FIG. 3, it will be appreciated that in the embodiment of the invention shown therein, the distance a is substantially equal to the width w plus ¼ of the waveguide wavelength $\lambda_g$. The third conductive structure 120 can, as shown, substantially coincide with the first longitudinal edge 108 of the slot 104. "Substantially coinciding" is intended to refer to a spatial orientation wherein the third conductive structure 120 is even with or only slightly displaced from the first longitudinal edge 108 of the slot 104. Further, the fourth conductive structure 122, in the embodiment depicted in FIG. 3, can be located beyond the second longitudinal edge 110 of the slot 104, spaced from the third conductive structure 120 in a direction moving from the first longitudinal edge 108 of the slot 104 to the second longitudinal edge 110 of the slot 104.

Figure 4:
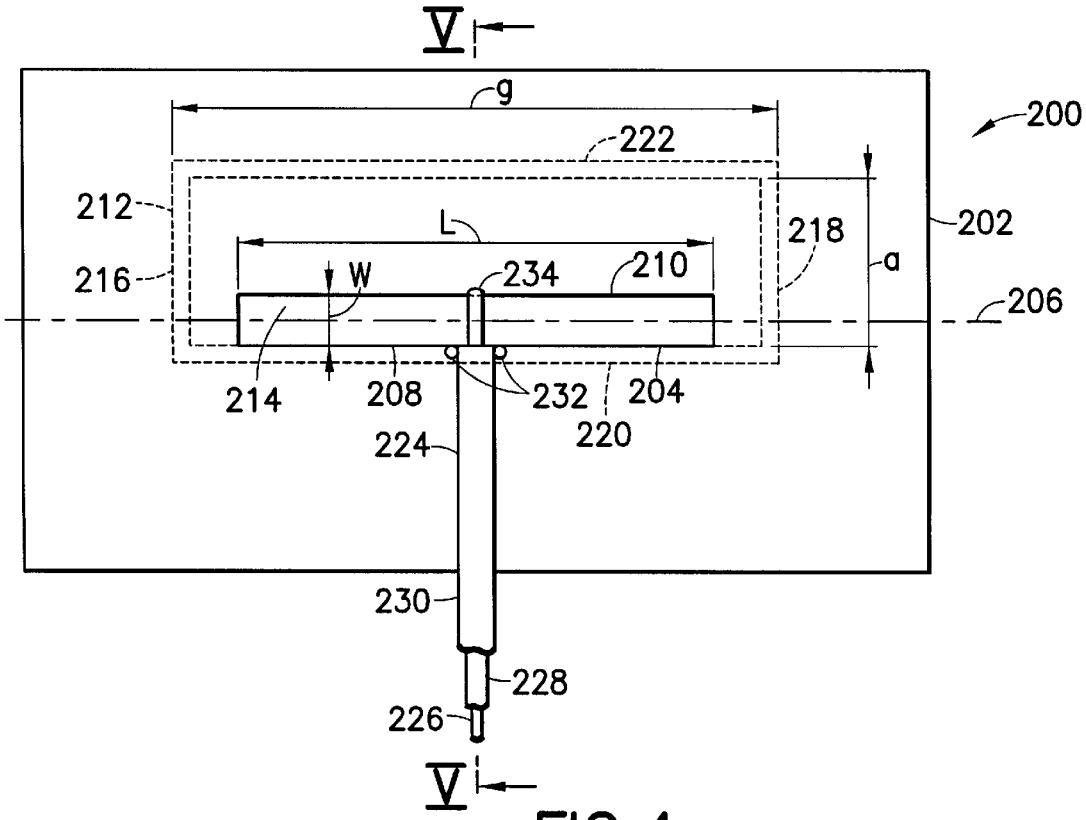
FIG. 4 is a plan view of an antenna according to the present invention, similar to that depicted in FIG. 3, and having the conductive box structure formed of conductive plates.
Figure 5:
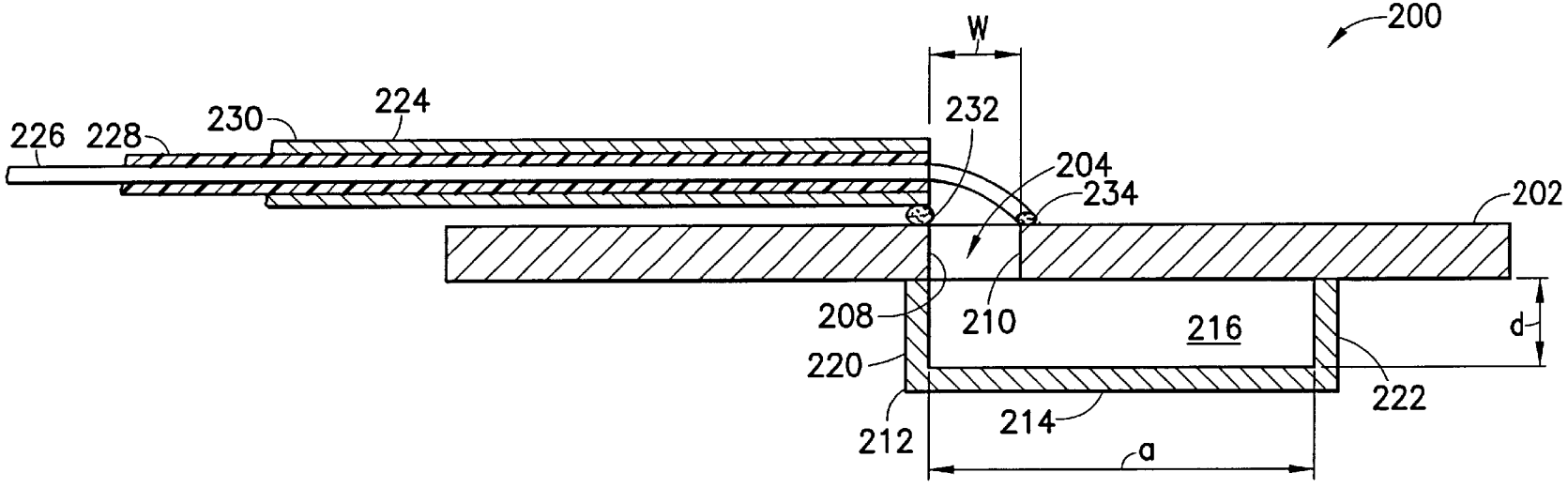
FIG. 5 is a cross-sectional view taken along line V—V in FIG. 4.

Reference should now be had to FIGS. 4 and 5, which depict plan and cross-sectional views respectively of an embodiment of the invention similar to that shown in FIG. 3 wherein the reference characters associated with like components have received the same number as in FIG. 3 but incremented by the value of 100, wherein the first through fourth conductive structures are formed as conductive plates, for example, metallic plates. It will be appreciated that the conductive ground plane 202 and main conductive plane 114 could also be formed as conductive, for example metallic, plates. The embodiment depicted in FIGS. 4 and 5 can be fed, for example, with a coaxial cable 224, having a conventional center conductor 226, insulator 228, and outer conductor 230, in a well-known fashion. Outer conductor 230 of coaxial cable 224 can be soldered to first longitudinal edge 208 of slot 204 through a solder bead 232, while center conductor 226 of coaxial cable 224 can be soldered to second longitudinal edge 210 of slot 204 at a solder bead 234. While the outer conductor 230 of coaxial cable 224 is shown as being spaced from conductive ground plane 202, with conductive contact only at solder bead 232, it should be appreciated that the outer conductor 230 can be maintained in contact with the conductive ground plane 202 if desired (such contact may be advantageous).

It will be appreciated that no coaxial cable, microstrip feed structure, or other type of antenna feed device is depicted in FIG. 3; this is purely for purposes of illustrative convenience. Further, it will be appreciated that the feed, such as the coaxial cable 224, can be located substantially centered in the slot 204, as shown in FIG. 4, or can be displaced therefrom, which will result in a lower impedance.

Figure 6:
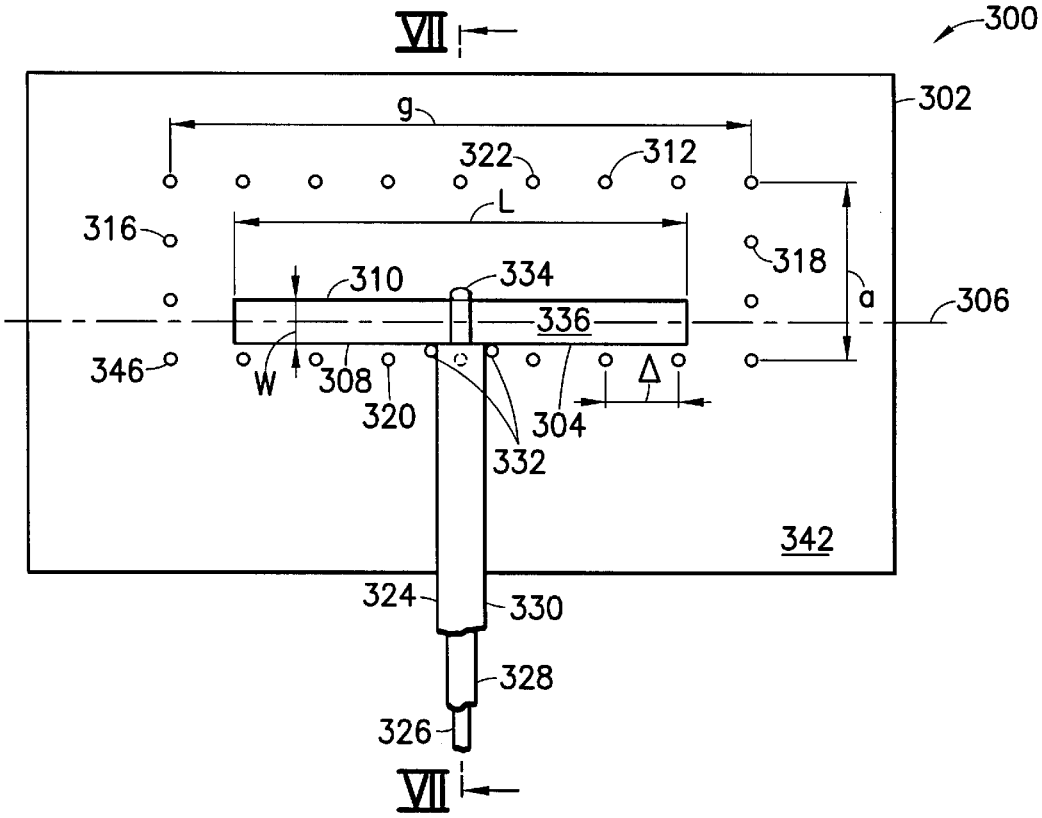
FIG. 6 is a plan view of an antenna in accordance with the present invention, similar to that depicted in FIG. 3, wherein the conductive box structure is formed of a series plated through holes.
Figure 7:
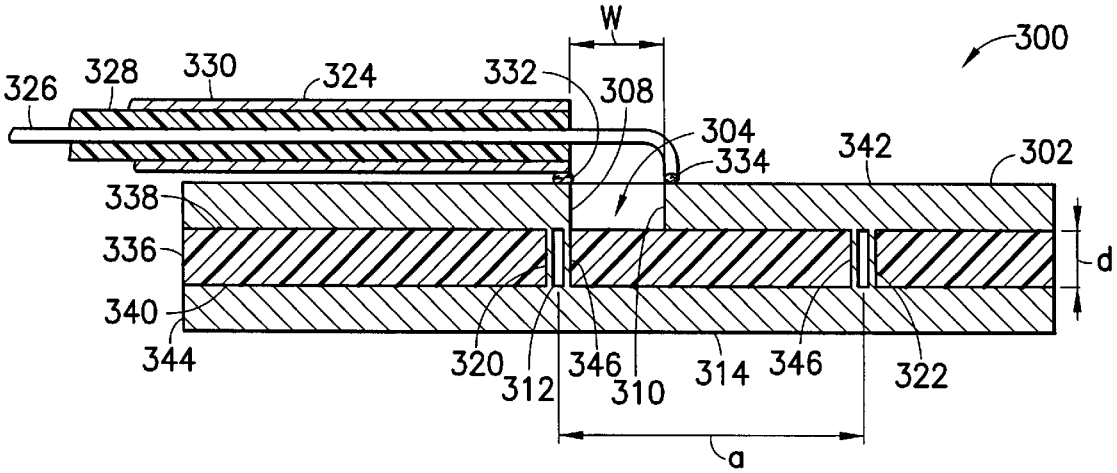
FIG. 7 is a cross-sectional view of the antenna of FIG. 6 taken along line VII—VII of FIG. 6.

Reference should now be had to FIGS. 6 and 7 which depict an embodiment of the invention similar to that shown in FIG. 3, which employs printed circuit board (PCB) technology. Items in FIGS. 6 and 7 which are similar to those in FIGS. 4 and 5 have received the same reference character incremented by 100. The embodiment of FIGS. 6 and 7 is designated generally as 300, and can include a first printed circuit board substrate 336 having first and second generally planar surfaces 338, 340 respectively. The conductive ground plane 302 can be formed as a first conductive layer 342 which is deposited on the first generally planar surface 338 of the first PCB substrate 336. The slot 304 can be etched in the first conductive layer 342. The main conductive plane 314 can be formed as a second conductive layer 344 which is deposited on the second generally planar surface 340 of the first PCB substrate 336. The first, second, third and fourth conductive structures 316, 318, 320, 322 respectively can each be formed as a series of plated through holes 346 which are formed in the first PCB substrate 336 using techniques well known in the art of printed circuit board fabrication. It will be appreciated that the plated through holes 346 provide an electrically conductive path between the first and second conductive layers 342, 344. As best seen in FIG. 6, the plated through holes 346 which form the conductive structures can be spaced apart by a distance $\Delta$, which is preferably no more than substantially one tenth of the free-space wavelength $\lambda$. The foregoing terminology is meant to cover plated through holes which are spaced slightly more than one tenth of $\lambda$ apart, but which are still functional, and any closer spacing of the through holes 346. The second conductive layer 344 can extend over the entire second surface 340 of the first PCB substrate 336, or, if desired, can extend only over the region where it serves as the main conductive plane 314, that is, within the region defined by the plated through holes 346.

Note that the distances a and g can be measured from the center lines of the plated through holes in all PCB embodiments of the invention.

Coaxial cable 324 can be located in a centered position (shown) or off-center, as discussed above with regard to cable 224. This is generally true for all embodiments of the invention disclosed herein.

Figure 8:
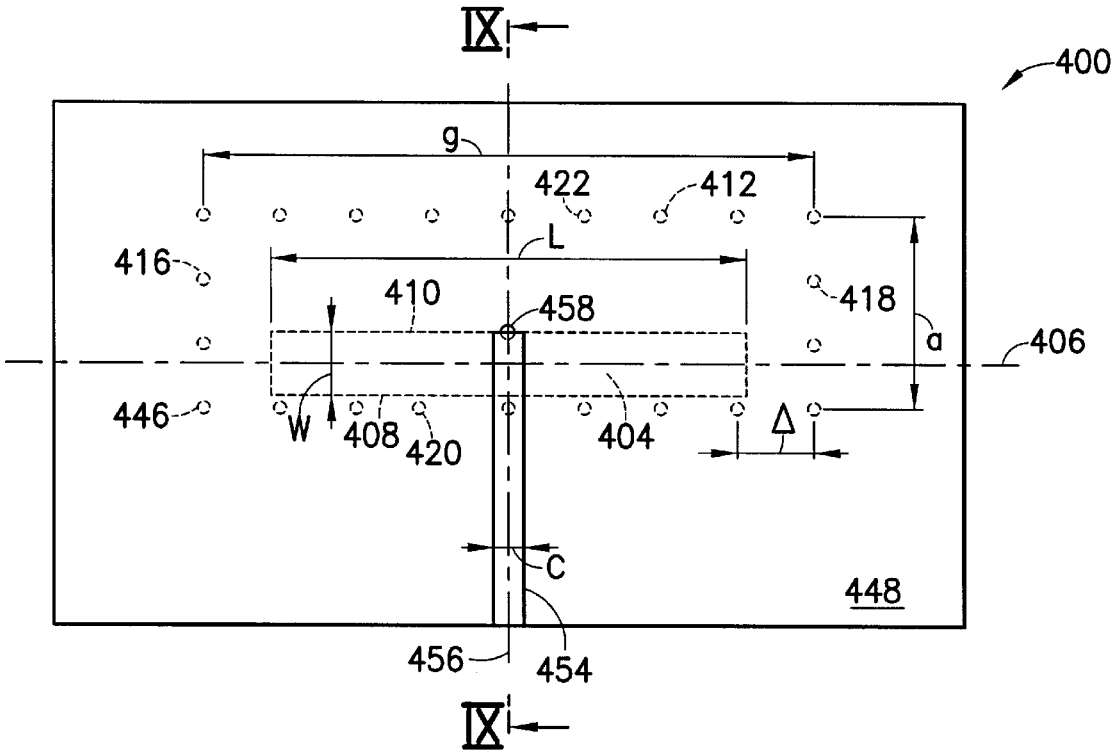
FIG. 8 is a view similar to FIG. 6 employing a microstrip rather than a coaxial feed structure.
Figure 9:
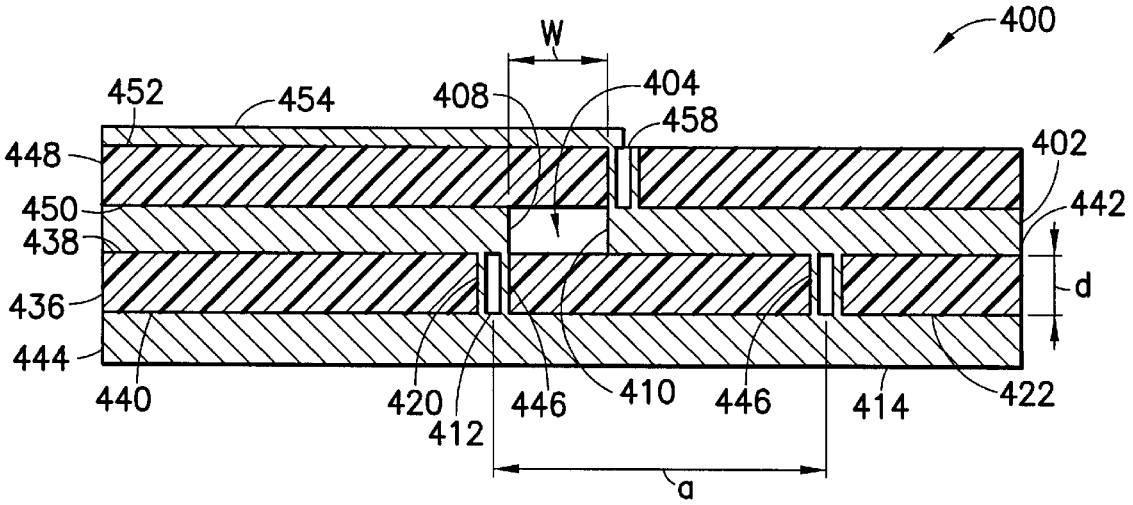
FIG. 9 is a cross-sectional view taken along line IX—IX in FIG. 8.

Reference should now be had to FIGS. 8 and 9, which depict an embodiment of the invention similar to that depicted in FIGS. 6 and 7, but wherein a microstrip feed structure is employed in lieu of a coaxial cable. Items in FIGS. 8 and 9 similar to those in FIGS. 6 and 7 have received the identical reference character incremented by 100. The embodiment shown in FIGS. 8 and 9 can include a second PCB substrate 448 having an inner side 450 and an outer side 452. The inner side 450 of the second PCB substrate 448 can be located adjacent the conductive ground plane 402. The antenna 400 can further include a conductive strip 454 which is located on the outer side 452 of the second PCB substrate 448. The conductive strip 454 can have a width c and can have a longitudinal axis 456 (which is coincident with the cutting plane line IX—IX in FIG. 8) which is substantially perpendicular to the longitudinal axis 406 of the slot 404 (at least in the region close to the slot). The thickness of the conductive strip 454 can be any appropriate value as selected by those of skill in the art. The conductive strip 454 can be electrically interconnected to one of the first and second longitudinal edges 408, 410 of the slot 404, and can extend from the longitudinal edge to which it is interconnected towards the other of the first and second longitudinal edges 108, 110 of the slot 104. In the embodiment shown in FIGS. 8 and 9, the conductive strip 454 is electrically interconnected to the second longitudinal edge 410 of the slot 404, and extends back towards, and beyond, the first longitudinal edge 408 of the slot 404. It will be appreciated that the conductive strip 454, the second PCB substrate 448, and the conductive ground plane 402 are configured so as to form a microstrip feed structure for the antenna 400.

The strip 454 can be centered with regard to the slot 404, as shown in FIG. 8, or can be displaced laterally therefrom, which will tend to lower the impedance Z.

The conductive strip 454 can be electrically interconnected to the one of the first and second longitudinal edges 408, 410 of the slot 404 to which it is desired to be connected by a plated through hole connection 458 which is formed in the second PCB substrate 448.

Attention should now be given to FIG. 10, which is a semi-schematic view similar to FIG. 3, but depicting an alternative form of the present invention. Items in FIG. 10 similar to those in FIG. 3 have received the same reference character incremented by 400. It will be appreciated that the antenna 500 of FIG. 10 is similar to the antenna 100 of FIG. 3, except that in FIG. 10 the distance L is substantially equal to the distance g, while in FIG. 3, g>L. With air in the conductive box structure, g>L is preferred to support the $TE_{10}$ mode; with a dielectric (such as a PCB substrate) within the box structure, g=L can be acceptable. Increasing g can reduce $\lambda_g$.

Reference should now be had to FIG. 11 which depicts an embodiment of the invention similar to that depicted in FIG. 10, wherein similar items have received the same reference character incremented by 100. As in FIG. 10, the embodiment of FIG. 11 is depicted with L substantially equal to g. However, unlike FIGS. 3 and 10, where a was substantially equal to $\lambda_g/4+w$, the embodiment depicted in FIG. 11 shows a value of a which is substantially equal to $w+\lambda_g/2$. The higher value of a yields a higher bandwidth.

Attention should now be given to FIG. 12, which depicts a form of the invention similar to that shown in FIG. 11, but wherein g>L. Items in FIG. 12 similar to those in FIG. 11 have received the same reference character incremented by 100. With reference to FIG. 12, and as previously discussed with respect to FIG. 11, it will be appreciated that as depicted therein, the distance a is substantially equal to the width w plus ½ of the waveguide wavelength $\lambda_g$. Furthermore, the third conductive structure 620, 720 is spaced substantially ¼ of the waveguide wavelength $\lambda_g$ from the first longitudinal edge 608, 708 of the slot 604, 704, while the fourth conductive structure 622, 722 is spaced substantially ¼ of the waveguide wavelength $\lambda_g$ from the second longitudinal edge 610, 710 of the slot 604, 704.

Figure 13:
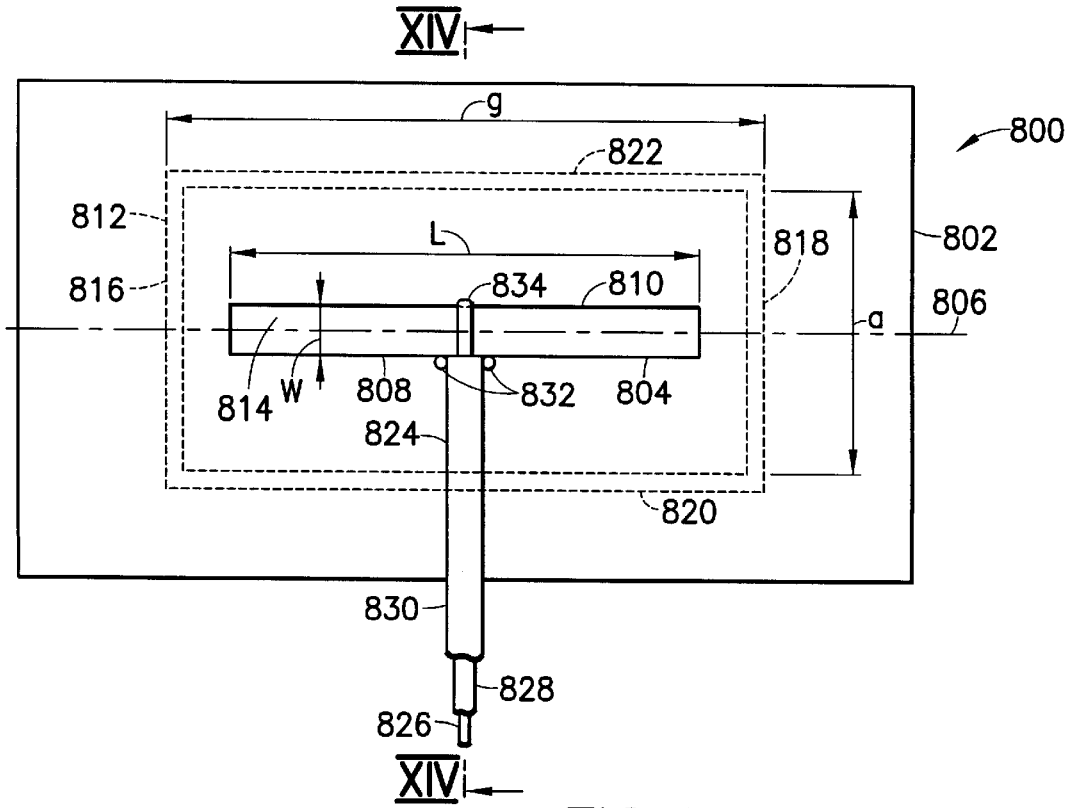
FIG. 13 is a plan view of an embodiment of the invention similar to that depicted in FIG. 12 wherein the conductive structures are conductive plates.
Figure 14:
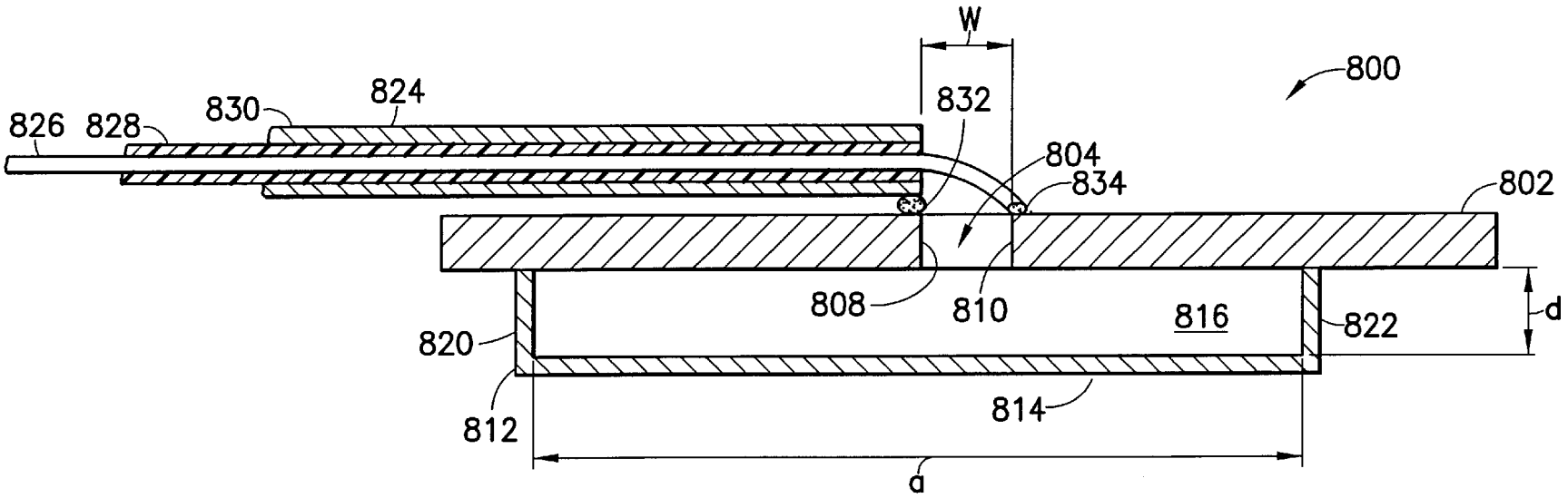
FIG. 14 is a cross-sectional view taken along line XIV—XIV in FIG. 13.

Just as for the embodiment of FIG. 3, in the embodiments just discussed, the first, second, third and fourth conductive structures 616, 618, 620, 622 and 716, 718, 720, 722 can be made of conductive plates, such as metallic plates. This is depicted in FIGS. 13 and 14, which are similar to FIGS. 4 and 5 except for the larger value of a. Items in FIGS. 13 and 14 similar to those in FIGS. 4 and 5 have received the same reference character incremented by 600. Other than the larger value of a, the construction of the embodiments shown in FIGS. 13 and 14 is similar to that discussed above with respect to FIGS. 4 and 5, and need not be discussed again.

In addition to the just-discussed embodiments wherein the first through fourth conductive structures were conductive plates, such as metallic plates, embodiments with the larger value of a can also be constructed using printed circuit board techniques, as discussed above with respect to the smaller value of a, and can be fed from either coaxial cables or microstrip feed structures, or in any other suitable manner.

Figure 15:
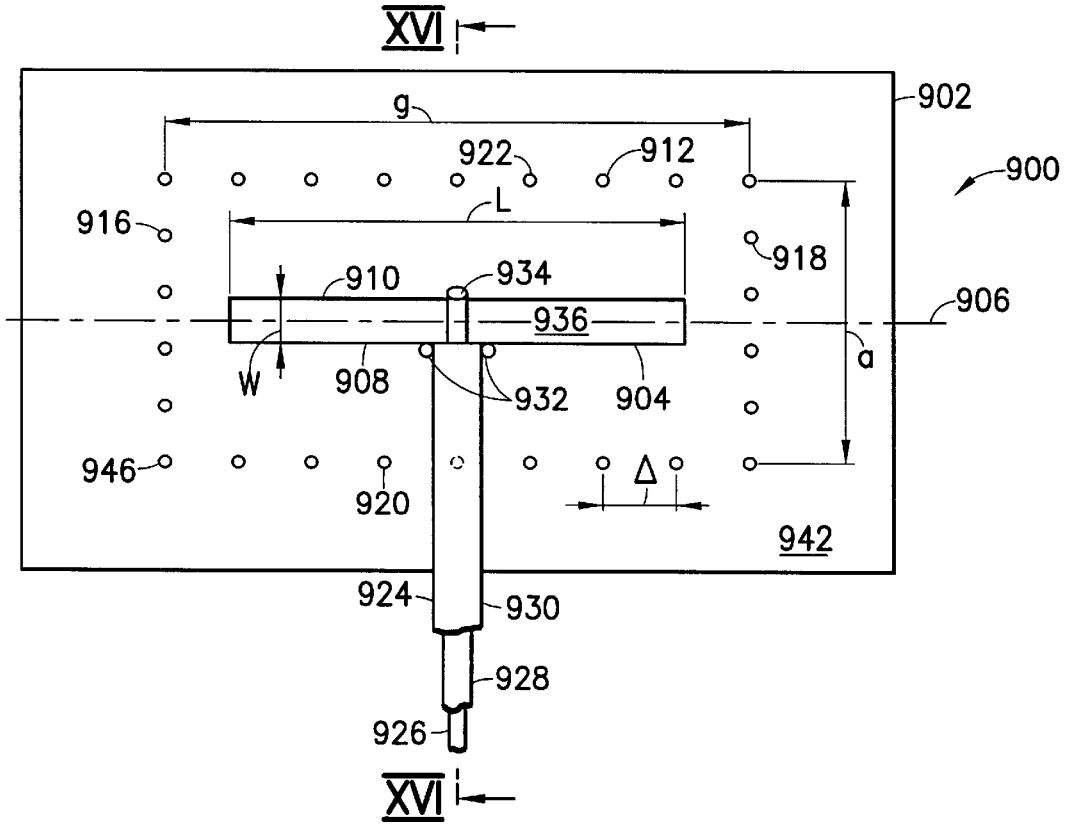
FIG. 15 is a plan view similar to FIG. 13, but showing an embodiment of the invention wherein the conductive structures are formed from plated through holes.
Figure 16:
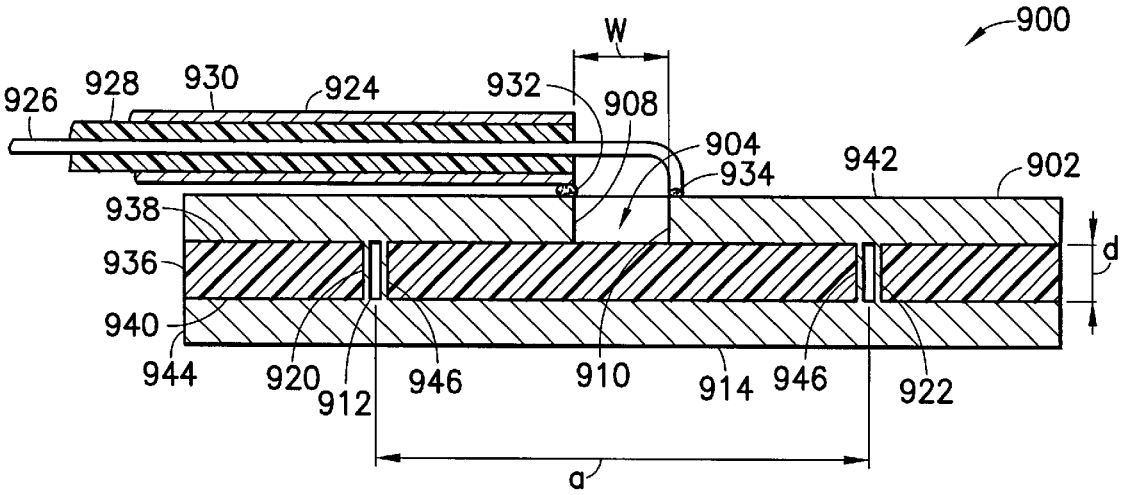
FIG. 16 is a cross-sectional view taken along line XVI—XVI in FIG. 15.

FIGS. 15 and 16 depict an embodiment of the invention similar to that shown in FIGS. 6 and 7, wherein similar items have received the same reference character as in FIGS. 6 and 7 incremented by 600. Except for the larger value of a, construction is similar to the earlier-discussed embodiments.

Figure 17:
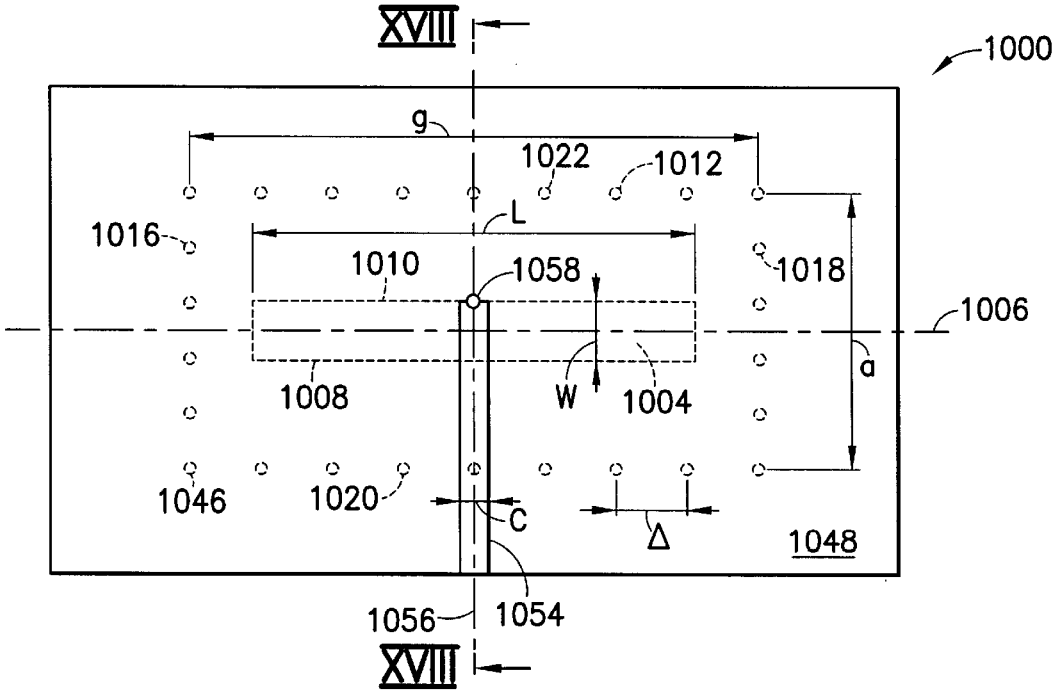
FIG. 17 is a view similar to FIG. 15, but showing an embodiment of the invention employing a microstrip feed structure rather that a coaxial cable.
Figure 18:
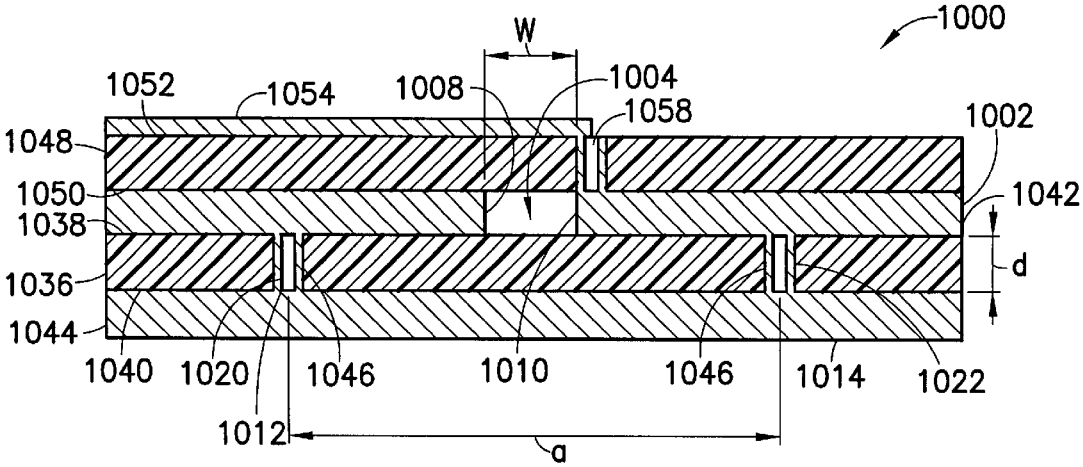
FIG. 18 is a cross-sectional view taken along line XVIII—XVIII of FIG. 17.

Finally, attention should be given to FIGS. 17 and 18, which depict an embodiment of the invention similar to that shown in FIGS. 8 and 9, including a microstrip feed structure, but with the larger value of a. Items in FIGS. 17 and 18 similar to those in FIGS. 8 and 9 have received the same reference character as in FIGS. 8 and 9, incremented by 600. Other than the larger value of a, construction of the embodiment of FIGS. 17 and 18 is similar to that FIGS. 8 and 9, and need not be further discussed.

In view of the foregoing descriptions, it will be appreciated that the present invention provides a conductive box structure which is parallel to the ground plane rather than perpendicular to the ground plane, as in the prior art, resulting in a design which can be easily constructed using printed circuit board technology, with a markedly reduced thickness compared to the prior art.

Referring to those embodiments of the invention where a is substantially equal to $\lambda_g/2+w$, it will be appreciated that, in effect, a second conductive box structure has been added in series with the conductive box structure of the embodiments with the smaller value of a. Thus, the larger value of a can improve the bandwidth of the slot antenna. For example, if the impedance provided by the box structure with the lower value of a is Z, the overall impedance provided by the box structure with the larger value of a (i.e., $a=w+\lambda_g/2$) will be 2Z. The larger the overall antenna impedance, the lower will be the effect on the antenna bandwidth which can be obtained from the conductive box structures. In those embodiments where the box structure dimension g is greater than the length L of the slot, a transverse electromagnetic wave having mode $TE_{10}$ (that is, a TE 10 wave) can exist. It will be appreciated that in all embodiments of the present invention, the conductive box structure functions as a waveguide and it is desirable to set up a standing wave within the conductive box structure. It is preferred that a should be equal to either $w+\lambda_g/4$ or $w+\lambda_g/2$, in order to obtain the best performance, but other values are functional, and such other values are also within the scope of the invention.

It will be appreciated that the operating frequency, dielectric characteristics (i.e., dielectric constant $\epsilon_r$) of the substrate materials, and the dimension g of the conductive box structure, as well as its depth d, will determine the waveguide wavelength $\lambda_g$, with g and $\epsilon_r$ being most important. Similar considerations apply in other embodiments of the invention having air within the conductive box structure; of course, $\epsilon_r$ for air is near unity.

With regard to the embodiments depicted in FIGS. 8, 9, 17 and 18, it will be appreciated that the width of the conductive strip, c, can be selected so as to provide a desired characteristic impedance, such as, for example, 50 ohms. The first and second PCB substrates 436, 448, and 1036, 1048 can be made of different materials having different dielectric constants, and can have different thicknesses In all of the embodiments presented, it will be appreciated that the dimension L has a minimum value of approximately the electric half wavelength, that is, $\lambda_e/2$. Larger values can be employed. For example, a value of $L=0.7\ \lambda_e$ could be used. Preferably, $L<\lambda_e$ to suppress higher-order transmission modes. Reference should be had to the aforementioned antenna reference text by Kraus, Chapter 13 thereof. It will be further appreciated that increases in the value of L will tend to lower the impedance Z. The impedance can also be lowered by using an off-center feed, but as shown in the drawings, the feed, whether microstrip or coaxial, could also be centered. In all embodiments, the axis of the feed, whether microstrip or coaxial, should be perpendicular to the slot, at least for some distance close to the slot, as will be appreciated by those of skill in the antenna art.

In all embodiments, the conductive ground plane should be as large as possible, but any dimensions which yield a functional antenna are within the scope of the invention. Preferred minimum dimensions are approximately $0.75\lambda$ in the direction parallel to the longitudinal axis of the slot and approximately $0.5\lambda$ in the direction perpendicular to the longitudinal axis of the slot.

Figure 21:
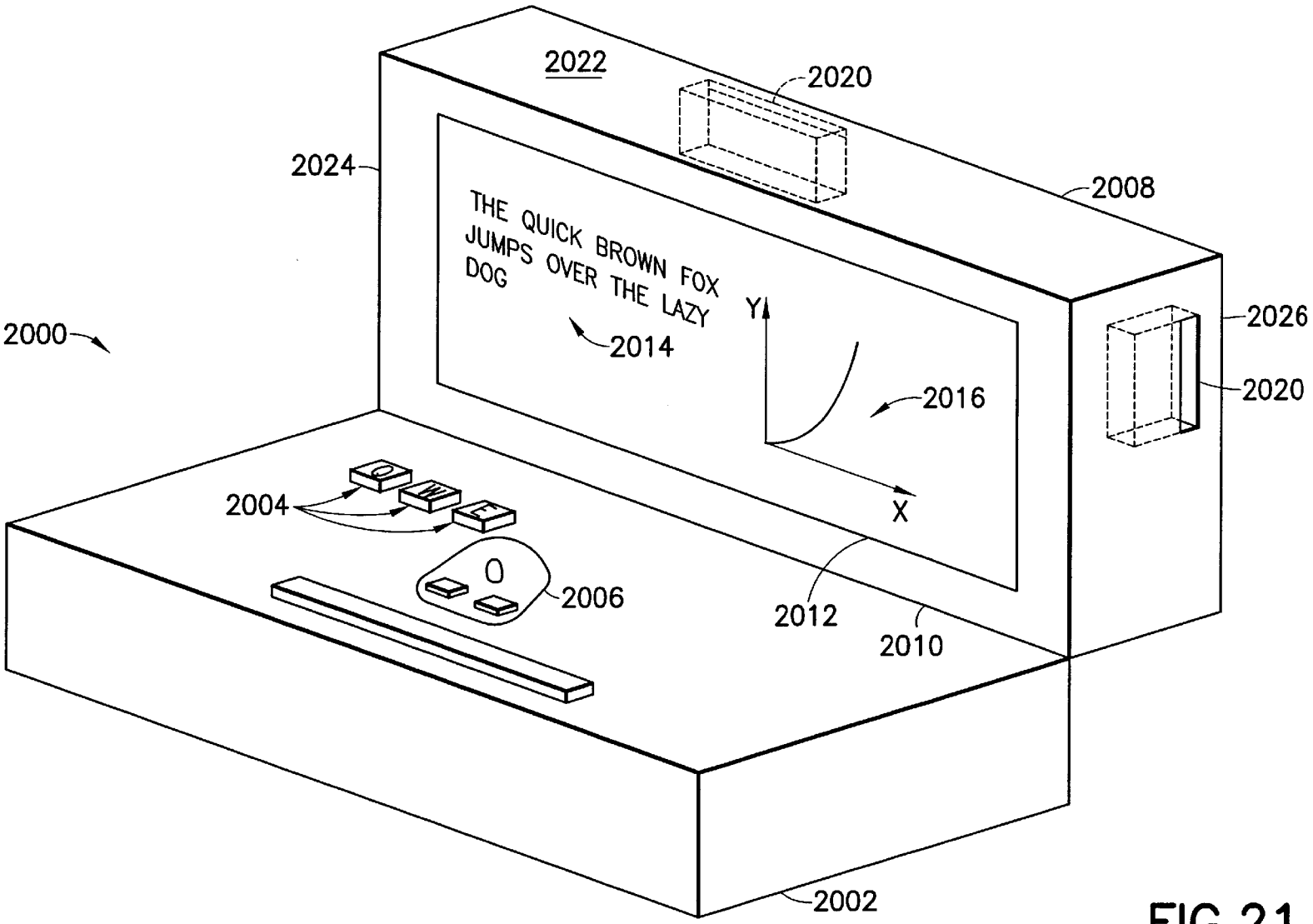
FIG. 21 is a semi-schematic perspective view of a portable electronic device having an antenna installation in accordance with the present invention.

Attention should now be given to FIG. 21. The present invention contemplates the combination of a portable electronic device, designated generally as 2000, with any type of antenna in accordance with the present invention. Such a device could be a laptop computer, personal digital assistant, or other device. As shown in FIG. 21, such a device could have a first portion 2002 with, for example, alphanumeric keys 2004 (only a few are shown for illustrative convenience) and a pointing device 2006. A second portion 2008 could be secured to first portion 2002 at a hinged edge 2010. Second portion 2008 could include a display 2012 for data of a textual and/or graphical nature 2014, 2016 respectively. One or more antennas 2020, of any configuration in accordance with the present invention, can be employed in conjunction with device 2000. Multiple antennas could be used, for example, where it was desired to communicate on different frequencies, or in a system where diversity was required or desired.

A preferred location for the antenna is on the second portion 2008 which has the display 2012, close to the top 2022. A first antenna 2020 is shown adjacent the right edge 2026 of portion 2008, facing sideways. A second antenna 2020 is shown adjacent the top 2022 of portion 2008 facing away from a user (not shown) who would be typing on keys 2004. Due to reflections in the indoor environment, either of the indicated orientations should be functional. The preferred location is high up on portion 2008 (i.e., near the top 2022) and close to the top or one of the edges 2024, 2026. When located adjacent an edge 2024, 2026, antenna 2020 should still be near the top 2022, as shown. Preferably, the antenna(s) should face sideways or away from the user, but any other functional orientation (e.g., upwards) should be considered as within the scope of the present invention.

The ground plane of antenna 2020 should be grounded to a conductive portion of the device 2000, for example, an existing metallic structural portion (and can even be formed integrally therewith). No other portion of the antenna 2020 should touch any conductive or metallic portion of device 2000.

The disclosure of U.S. patent application Ser. No. 09/598,719 filed Jun. 21, 2000 under IBM docket number YOR9-2000-0206US1, entitled "An Integrated Antenna for Laptop Applications" by Ephraim Bemis Flint, Brian Paul Gaucher and Duixian Liu is expressly incorporated herein by reference in its entirety.

EXAMPLE

Performance of a boxed-in slot antenna, with the inventive folded, space-saving configuration for the conductive box structure, was predicted via simulation with Zeland's IE3D computer program. Performance of an embodiment of the invention similar to that shown in FIG. 10 was predicted (i.e., g=L, $a=w+\lambda_g/4$), but for a printed circuit board configuration, fed by a coaxial cable, similar to that shown in FIGS. 6 and 7 (but, as noted, with g=L). The conductive ground plane had a dimension of 70 mm perpendicular to the slot and 99 mm parallel to the slot. The slot width was w=3 mm, with g=L=50.5 mm. The first PCB substrate had a thickness of 3 mm and a relative dielectric constant of 4.6. A value of $\lambda_g/4=19.75$ mm was used such that a was 22.75 mm.

Figure 20:
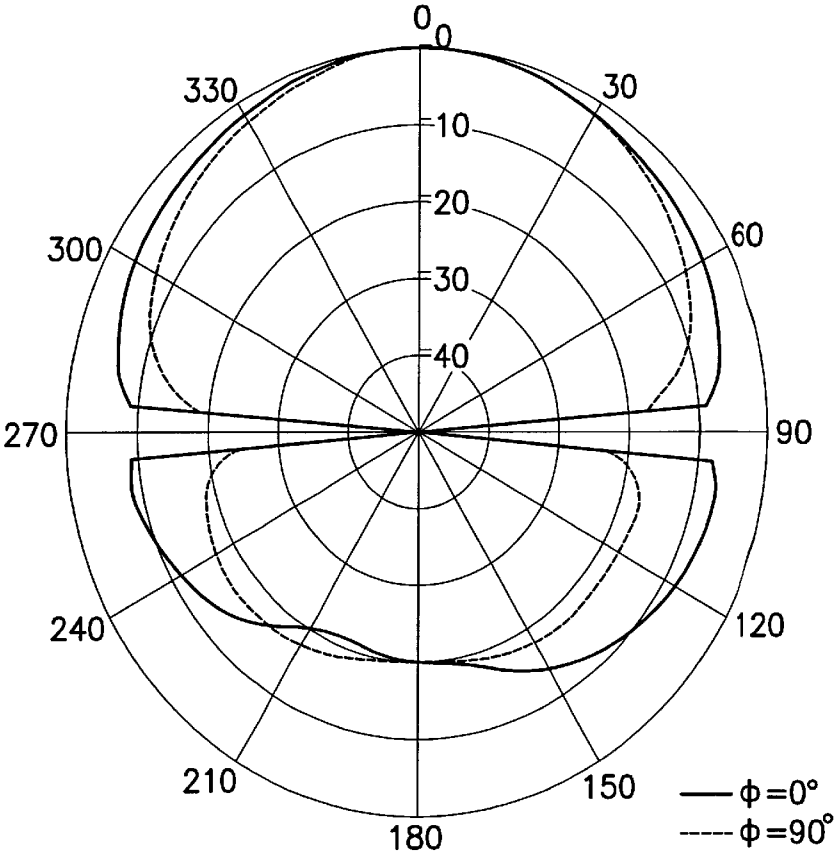
FIG. 20 shows the elevation plane radiation patterns of the antenna for $\phi=0°$ ( slot width direction) and for $\phi=90°$ (slot length direction) respectively, again, for the exemplary embodiment for which the VSWR was shown in FIG. 19.
Figure 19:
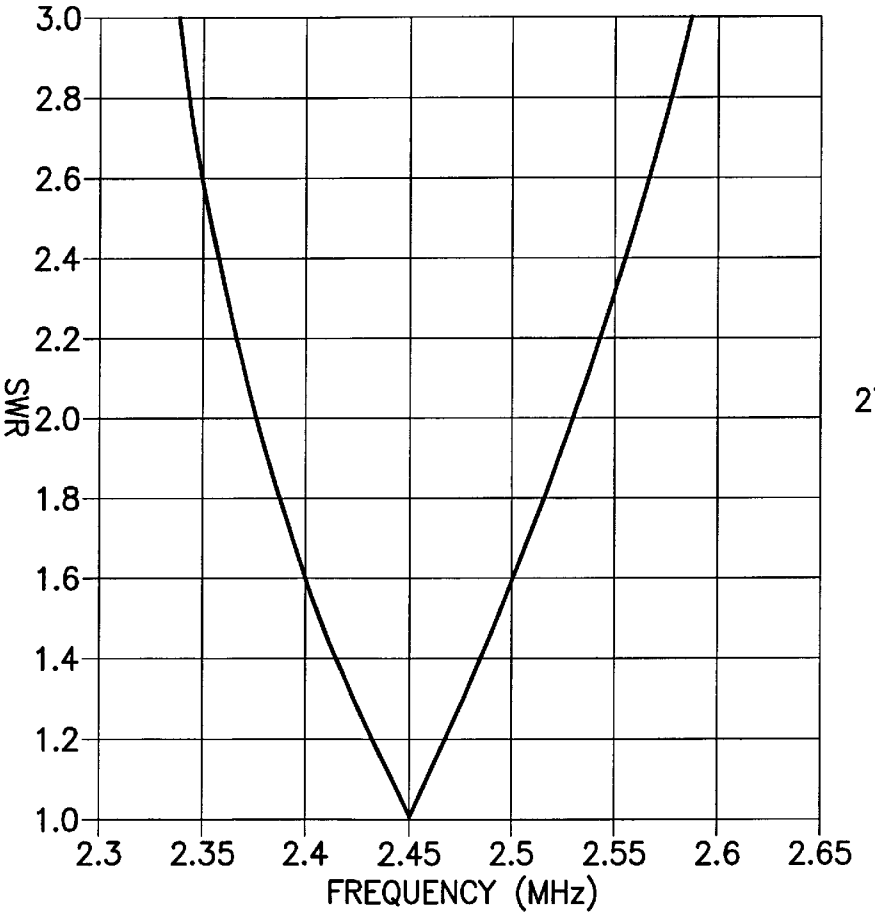
FIG. 19 is a plot of antenna voltage standing wave ratio (VSWR) as a function of operating frequency, for one exemplary embodiment of the present invention.

FIG. 19 depicts the predicted voltage standing wave ration (VSWR) of the antenna. The 2:1 VSWR bandwidth is 154 MHz, which is sufficiently wide for 2.4 GHz ISM applications. FIG. 20 shows the simulated elevation plane radiation patterns of the antenna for $\phi=0°$, i.e., the slot width direction, and $\phi=90°$, i.e., the slot length direction, respectively. The maximum predicted gain for the antenna is 6.4 dB.

While there have been described what are presently believed to be the preferred embodiments of the invention, those skilled in the art will realize that various changes and modifications can be made to the invention without departing from the spirit of the invention, and it is intended to claim all such changes and modifications as fall within the scope of the invention.

What is claimed is:

1. In a boxed-in slot antenna for radiation having a free-space wavelength $\lambda$, a waveguide wavelength $\lambda_g$, and an electric half-wavelength $\lambda_e/2$, said antenna having:

(a) a conductive ground plane having a slot formed therein, said slot having a length L at least substantially equal to said electric half wavelength, said slot also having a width w which is less than said length L, said slot further having a longitudinal axis and first and second longitudinal edges; and (b) a conductive box structure which is conductively secured to said conductive ground plane and which is configured to cause said slot antenna to radiate from only a single side of said conductive ground plane;

the improvement comprising:

a folded, space-saving configuration for said conductive box structure, said conductive box structure in turn comprising:

(b-1) a main conductive plane which is substantially parallel to said ground plane and which is spaced a distance d therefrom, said distance d being substantially less than one-quarter of said waveguide wavelength $\lambda_g$;

(b-2) first and second conductive structures which are substantially parallel to each other and which are spaced apart a distance g which is at least substantially equal to L, said first and second conductive structures being substantially perpendicular to said conductive ground plane and said main conductive plane and also being substantially perpendicular to said longitudinal axis of said slot; and (b-3) third and fourth conductive structures which are substantially parallel to each other and which are spaced apart a distance a, said third and fourth conductive structures being substantially perpendicular to said conductive ground plane and said main conductive plane and also being substantially parallel to said longitudinal axis of said slot; wherein:

said first, second, third and fourth conductive structures form conductive paths between said conductive ground plane and said main conductive plane; and when viewed in plan, said first, second, third and fourth conductive structures bound said slot; whereby:

said folded, space-saving configuration for said conductive box structure is formed.

2. The antenna of claim 1, wherein:

said distance a is substantially equal to said width w plus one-quarter of said waveguide wavelength $\lambda_g$;

said third conductive structure substantially coincides with said first longitudinal edge of said slot;

said fourth conductive structure is located beyond said second longitudinal edge of said slot, spaced from said third conductive structure in a direction moving from said first longitudinal edge of said slot to said second longitudinal edge of said slot.

3. The antenna of claim 2, wherein said first, second, third and fourth conductive structures are conductive plates.

4. The antenna of claim 2, further comprising:

a first printed circuit board (PCB) substrate having first and second generally planar surfaces; wherein:

said conductive ground plane is formed as a first conductive layer deposited on said first generally planar surface of said first PCB substrate, said slot being etched in said first conductive layer;

said main conductive plane is formed as a second conductive layer deposited on said second generally planar surface of said first PCB substrate; and said first, second, third and fourth conductive structures each comprise a series of plated through holes formed in said first PCB substrate, adjacent ones of said plated through holes being spaced apart no more than substantially one tenth of said free-space wavelength $\lambda$.

5. The antenna of claim 4, further comprising:

a second PCB substrate having inner and outer sides, said inner side being located adjacent said conductive ground plane; and a conductive strip located on said outer side of said second PCB substrate; wherein:

said conductive strip has a width c and a longitudinal axis which is substantially perpendicular to said longitudinal axis of said slot;

said conductive strip is electrically interconnected to one of said first and second longitudinal edges of said slot, said conductive strip extending from said longitudinal edge to which it is interconnected towards another of said first and second longitudinal edges of said slot; and said conductive strip, said second PCB substrate and said conductive ground plane are configured to form a microstrip feed structure for said antenna.

6. The antenna of claim 5, wherein said conductive strip is electrically interconnected to said one of said first and second longitudinal edges of said slot by a plated through hole formed in said second PCB substrate.

7. The antenna of claim 1, wherein:

said distance a is substantially equal to said width w plus one-half of said waveguide wavelength $\lambda_g$;

said third conductive structure is spaced substantially one-quarter of said waveguide wavelength $\lambda_g$ from said first longitudinal edge of said slot; and said fourth conductive structure is spaced substantially one-quarter of said waveguide wavelength $\lambda_g$ from said second longitudinal edge of said slot.

8. The antenna of claim 7, wherein said first, second, third and fourth conductive structures are conductive plates.

9. The antenna of claim 7, further comprising:

a first printed circuit board (PCB) substrate having first and second generally planar surfaces; wherein:

said conductive ground plane is formed as a first conductive layer deposited on said first generally planar surface of said first PCB substrate, said slot being etched in said first conductive layer;

said main conductive plane is formed as a second conductive layer deposited on said second generally planar surface of said first PCB substrate; and said first, second, third and fourth conductive structures each comprise a series of plated through holes formed in said first PCB substrate, adjacent ones of said plated through holes being spaced apart no more than substantially one tenth of said free-space wavelength $\lambda$..

10. The antenna of claim 9, further comprising:

a second PCB substrate having inner and outer sides, said inner side being located adjacent said conductive ground plane; and a conductive strip located on said outer side of said second PCB substrate; wherein:

said conductive strip has a width c and a longitudinal axis which is substantially perpendicular to said longitudinal axis of said slot;

said conductive strip is electrically interconnected to one of said first and second longitudinal edges of said slot, said conductive strip extending from said longitudinal edge to which it is interconnected towards another of said first and second longitudinal edges of said slot; and said conductive strip, said second PCB substrate and said conductive ground plane are configured to form a microstrip feed structure for said antenna.

11. The antenna of claim 10, wherein said conductive strip is electrically interconnected to said one of said first and second longitudinal edges of said slot by a plated through hole formed in said second PCB substrate.

12. A boxed-in slot antenna for radiation having a free-space wavelength $\lambda$, a waveguide wavelength $\lambda_g$, and an electric half-wavelength $\lambda_e/2$, said antenna comprising:

(a) a conductive ground plane having a slot formed therein, said slot having a length L at least substantially equal to said electric half wavelength, said slot also having a width w which is less than said length L, said slot further having a longitudinal axis and first and second longitudinal edges; and (b) a conductive box structure, said conductive box structure in turn comprising:

(b-1) a main conductive plane which is substantially parallel to said ground plane and which is spaced a distance d therefrom, said distance d being substantially less than one-quarter of said waveguide wavelength $\lambda_g$;

(b-2) first and second conductive structures which are substantially parallel to each other and which are spaced apart a distance g which is at least substantially equal to L, said first and second conductive structures being substantially perpendicular to said conductive ground plane and said main conductive plane and also being substantially perpendicular to said longitudinal axis of said slot; and (b-3) third and fourth conductive structures which are substantially parallel to each other and which are spaced apart a distance a, said third and fourth conductive structures being substantially perpendicular to said conductive ground plane and said main conductive plane and also being substantially parallel to said longitudinal axis of said slot; wherein:

said first, second, third and fourth conductive structures form conductive paths between said conductive ground plane and said main conductive plane; and when viewed in plan, said first, second, third and fourth conductive structures bound said slot.

13. The antenna of claim 12, wherein:

said distance a is substantially equal to said width w plus one-quarter of said waveguide wavelength $\lambda_g$;

said third conductive structure substantially coincides with said first longitudinal edge of said slot;

said fourth conductive structure is located beyond said second longitudinal edge of said slot, spaced from said third conductive structure in a direction moving from said first longitudinal edge of said slot to said second longitudinal edge of said slot.

14. The antenna of claim 13, wherein said first, second, third and fourth conductive structures are conductive plates.

15. The antenna of claim 13, further comprising:

a first printed circuit board (PCB) substrate having first and second generally planar surfaces; wherein:

said conductive ground plane is formed as a first conductive layer deposited on said first generally planar surface of said first PCB substrate, said slot being etched in said first conductive layer;

said main conductive plane is formed as a second conductive layer deposited on said second generally planar surface of said first PCB substrate; and said first, second, third and fourth conductive structures each comprise a series of plated through holes formed in said first PCB substrate, adjacent ones of said plated through holes being spaced apart no more than substantially one tenth of said free-space wavelength $\lambda$.

16. The antenna of claim 15, further comprising:

a second PCB substrate having inner and outer sides, said inner side being located adjacent said conductive ground plane; and a conductive strip located on said outer side of said second PCB substrate; wherein:

said conductive strip has a width c and a longitudinal axis which is substantially perpendicular to said longitudinal axis of said slot;

said conductive strip is electrically interconnected to one of said first and second longitudinal edges of said slot, said conductive strip extending from said longitudinal edge to which it is interconnected towards another of said first and second longitudinal edges of said slot; and said conductive strip, said second PCB substrate and said conductive ground plane are configured to form a microstrip feed structure for said antenna.

17. The antenna of claim 16, wherein said conductive strip is electrically interconnected to said one of said first and second longitudinal edges of said slot by a plated through hole formed in said second PCB substrate.

18. The antenna of claim 12, wherein:

said distance a is substantially equal to said width w plus one-half of said waveguide wavelength $\lambda_g$;

said third conductive structure is spaced substantially one-quarter of said waveguide wavelength $\lambda_g$ from said first longitudinal edge of said slot; and said fourth conductive structure is spaced substantially one-quarter of said waveguide wavelength $\lambda_g$ from said second longitudinal edge of said slot.

19. The antenna of claim 18, wherein said first, second, third and fourth conductive structures are conductive plates.

20. The antenna of claim 18, further comprising:

a first printed circuit board (PCB) substrate having first and second generally planar surfaces; wherein:

said conductive ground plane is formed as a first conductive layer deposited on said first generally planar surface of said first PCB substrate, said slot being etched in said first conductive layer;

said main conductive plane is formed as a second conductive layer deposited on said second generally planar surface of said first PCB substrate; and said first, second, third and fourth conductive structures each comprise a series of plated through holes formed in said first PCB substrate, adjacent ones of said plated through holes being spaced apart no more than substantially one tenth of said free-space wavelength $\lambda$.

21. The antenna of claim 20, further comprising:

a second PCB substrate having inner and outer sides, said inner side being located adjacent said conductive ground plane; and a conductive strip located on said outer side of said second PCB substrate; wherein:

said conductive strip has a width c and a longitudinal axis which is substantially perpendicular to said longitudinal axis of said slot;

said conductive strip is electrically interconnected to one of said first and second longitudinal edges of said slot, said conductive strip extending from said longitudinal edge to which it is interconnected towards another of said first and second longitudinal edges of said slot; and said conductive strip, said second PCB substrate and said conductive ground plane are configured to form a microstrip feed structure for said antenna.

22. The antenna of claim 21, wherein said conductive strip is electrically interconnected to said one of said first and second longitudinal edges of said slot by a plated through hole formed in said second PCB substrate.

* * * * *